US005168519A

United States Patent [19]

Scarinci et al.

[11] Patent Number: 5,168,519

[45] Date of Patent: Dec. 1, 1992

[54] SYSTEM AND METHOD FOR SECURING DTMF TRANSMISSION

[75] Inventors: Dean Scarinci, Glendale; John M. Saltwick, Phoenix; William O. Sparks, Cave Creek; Geoffrey W. Gates, Phoenix, all of Ariz.

[73] Assignee: Syntellect Inc., Phoenix, Ariz.

[21] Appl. No.: 636,666

[22] Filed: Jan. 2, 1991

[51] Int. Cl.[5] ..... H04K 1/02

[52] U.S. Cl. ..... 380/6; 380/23; 380/25; 380/49

[58] Field of Search ..... 380/6, 7, 8, 49, 23–25

[56] References Cited

U.S. PATENT DOCUMENTS 2,645,677 7/1953 Young, Jr. ..... 380/7

3,718,765 2/1973 Halaby ..... 380/6

*Primary Examiner*—Bernarr E. Gregory

*Attorney, Agent, or Firm*—Streich Lang

[57] ABSTRACT

A technique for inhibiting intelligible interception of information signals transmitted over a line from a first site to a second site. A masking signal is applied to the line immediately upon the detection of the information signal at the second site, but prior to the time at which the validity of the signal is verified. As long as the information signal remains on the transmission line, the masking signal is repeatedly turned on and off to thereby inhibit decoding of the signal by an eavesdropping device.

20 Claims, 4 Drawing Sheets

SYSTEM AND METHOD FOR SECURING DTMF TRANSMISSION

This invention relates to communications systems, and more particularly to security protection arrangements therefor.

The use of the public telephone system for computer communications and other data services is widespread. Services which are provided involve access to bank accounts, credit limit reporting, credit card transactions, and order entry functions.

Communications are typically accomplished by encoding data to be transmitted as data signals. Examples of encoding are frequency shift keying (FSK), phase shift keying (PSK), and other forms of modulation using modems. Among the more popular forms of transmission are dual tone multi-frequency data (DTMF), commonly called Touchtone, and multi-frequency (MF) data encoding. As used herein, the term "DTMF signals" embraces all forms of tone signals.

In order for a caller to access specific information it is usually necessary for the caller to enter an identifying number, such as an account number. For sensitive transactions such as funds transfer, accepted security procedures also require the entry of a security code, commonly known as a personal identification number or PIN. When transmitted, the account number and PIN are subject to compromise by someone eavesdropping on the communications line with a decoding device.

In U.S. Pat. No. 4,972,469 entitled "System And Method For Communications Security Protection," and in Ser. No. 354,261 entitled "System and Method for Communications Security Protection," there are disclosed techniques for using a masking signal, applied to a line at the receiving unit, during input of sensitive information at the sending device. A masking signal, as used herein, is a signal which tends to disable or confuse an eavesdropping detector. Examples are signals which distort the information signal; add to the frequency spectrum, amplitude and/or phase of the information signal; or are similar to the information signal so that a detector captures false information. The receiving unit is equipped with a means for canceling out the masking signal so that its signal detector is able to detect the information which was sent reliably and accurately. The cancellation of the masking signal is performed at the receiving site because the cancellation depends on knowledge of the specific characteristics of the masking signal and they may vary over time, e.g., in frequency, amplitude and/or phase.

As disclosed in said U.S. Pat. No. 4,972,469, the level of the information signal and/or the characteristics of the transmission media (e.g., the impedance of the telephone line) may be measured. The first portion of the information signal received (e.g., the first tone) may be used to select at least an initial characteristic of the masking signal (e.g., the amplitude) so that the masking signal strikes a compromise between providing security which is not confusing to the receiving unit, and meeting government regulations with respect to permissible transmission levels.

The exact nature of the masking signal depends on the encoding technique used for the information signal to be protected. One common way of encoding numeric information is to use the dual tone multi-frequency scheme (DTMF). In this scheme, the keypad comprises four rows of four buttons each. Each row and column has a unique frequency associated with it. Depressing a key sends a signal consisting of the corresponding row frequency and column frequency. For example, the digit 1 is sent as a signal composed of tones at 697 Hz and 1,209 Hz. A DTMF detector decodes a valid digit only when it receives exactly one row frequency and one column frequency. If two or more row or column tones are detected simultaneously, or in some cases if a tone which is not either a row or column tone is detected, the signal is not recognized as a valid DTMF digit. This scheme is used to prevent the improper detection of voice as a valid digit.

In order to mask the transmission of DTMF digits, a masking signal consisting of at least two row tones or two column tones can be used. Thus, no matter what row and column tones characterize a transmitted digit, an eavesdropper would detect at least three tones on the transmission line with no way to determine which two constitute the actual DTMF digit.

Another common data encoding technique is frequency shift keying (FSK). In this method, two or more carrier frequencies are used to encode binary data. With a tone of 980 Hz encoding a "mark", and a tone of 1,180 Hz encoding a "space", a masking signal consisting of the 980 Hz and the 1,180 Hz carrier frequencies could be used. In full duplex FSK, only the originate "mark" and "space" may need to be masked to provide security for the sending device.

The security techniques just described require the application of masking tones to the line throughout the interval during which the DTMF signalling is to be secure. It is because the masking tones may appear on the line from prior to the start of the transmission of the DTMF signals until after the expected termination of the signalling that attention must be given to calibrating the transmit level of the masking tones so that the receiver itself is not confused by these tones. Calibration is provided in order that the masking tones not affect the reception of the DTMF signals.

It has been discovered that some calling parties are uncomfortable with hearing tones applied to the line before they operate their keypads. In order to completely bracket the inputting of data which is to be secured, the masking tones have to be applied even before the calling party operates his keypad. The unnaturalness of the signalling sequence is a shortcoming of the earlier approach. Another problem with the earlier approach is that preliminary calibration is required even before the signalling begins.

It is an object of our invention to provide an alternative form of security system which is capable of overcoming the aforesaid problems. (This is not to say, however, that the earlier calibration techniques cannot be used together with the method of the present invention in order to provide even greater security.)

In accordance with the principles of our present invention, the masking tones are not transmitted until after a DTMF signal first appears on the line. The masking tones are applied, however, before the DTMF signal on the line can be verified. The masking signal is applied to the line at the receiver with an on/off sequence in such a manner as to confuse an eavesdropping device and yet still allow verification of each DTMF signal and a determination of its cessation. The on/off duty cycle is such that an eavesdropping device cannot properly respond to the DTMF signal.

It has been found that a typical calling party does not object to the masking tones because most people expect to hear a loud sidetone replica of the DTMF signal itself. The combined effect of the masking tone level mixed with the transmitted DTMF signal at the calling end simply results in a slight variation of the non-masked DTMF signal, something which is neither strange nor annoying. In order to avoid the appearance of a masking signal on the line when the calling party is not operating his keypad, it is important that the transmission of information by the calling party be detected immediately so that the masking signal can be applied to the line soon after the start of the DTMF signal such that an eavesdropping device does not have time to decode it. Similarly, it is preferable to rapidly sense the termination of the DTMF signalling so that the masking signal can be removed from the line in order that the calling party not hear any tones when he is not operating his keypad.

BRIEF DESCRIPTION OF THE DRAWINGS

Further objects, features and advantages of our invention will become apparent upon consideration of the following detailed description in conjunction with the drawing, in which.

Figure 2:
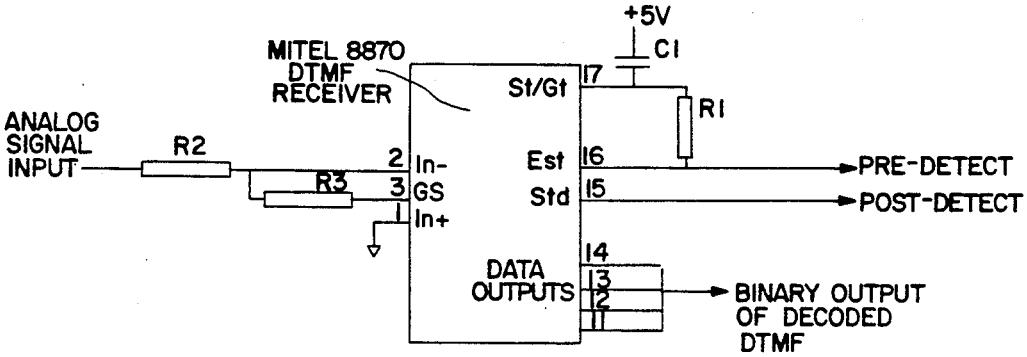
FIG. 2 is a representation of a prior art circuit which, when modified, can be used in implementing our invention.

A typical DTMF receiver is shown in FIG. 2; the heart of the circuit is a Mitel 8870 integrated circuit. Only those input and output pins are shown which are pertinent to a description of the invention. The analog signal input is applied at the left. Resistors R2 and R3 are bias and gain resistors, the values for which can be found in Mitel application notes. The bit outputs at pins 11–14 indicate which one of the 16 tone pairs has been detected. The two most important signals for present purposes are those at pins 15 and 16. The Est or pre-detect signal is generated when the receiver determines that the input analog waveform satisfies the built-in algorithm for a valid DTMF signal. According to Mitel specifications, the pre-detect line goes true 5–14 milliseconds after a valid DTMF signal is present at the analog input. The pre-detect signal, however, is not typically used to indicate reception of a valid DTMF signal because of what is known as a "talk-off" condition. Talk-off is the condition in which a voice waveform triggers a Touchtone or other DTMF receiver. The reason this happens is that a voice signal can contain DTMF frequencies in it, certainly for up to 14 milliseconds. As such, when the pre-detect line goes true, it is an indication that DTMF tones are on the line, but it is not known whether they are keypad-originated or voice-originated. In the art of DTMF decoding, the input waveform in monitored for a longer period of time before making a conclusive determination that a valid signal has been received.

This is controlled in the circuit of FIG. 2 by the time constant determined by resistor R1 and capacitor C1. The time constant determines the delay between the pre-detect line going true and the post-detect line going true. The longer the time constant, the less chance of a talk-off condition. Typically, the time constant is set in the 30–36 millisecond range. Assuming a maximum of 14 milliseconds before the pre-detect line goes true and a maximum of 36 milliseconds for the post-detect line to go true following the pre-detect line, it is apparent that it requires up to 50 milliseconds for a received DTMF signal to be determined as valid. Such timing is consistent with that recommended by AT&T. When the post-detect line goes high, the DTMF signal being received is represented on pins 11–14. In fact, the bits on pins 11–14 only change when the post-detect pin first goes high; until then the DTMF code represented is that corresponding to the previously decoded tone pair.

Figure 3:
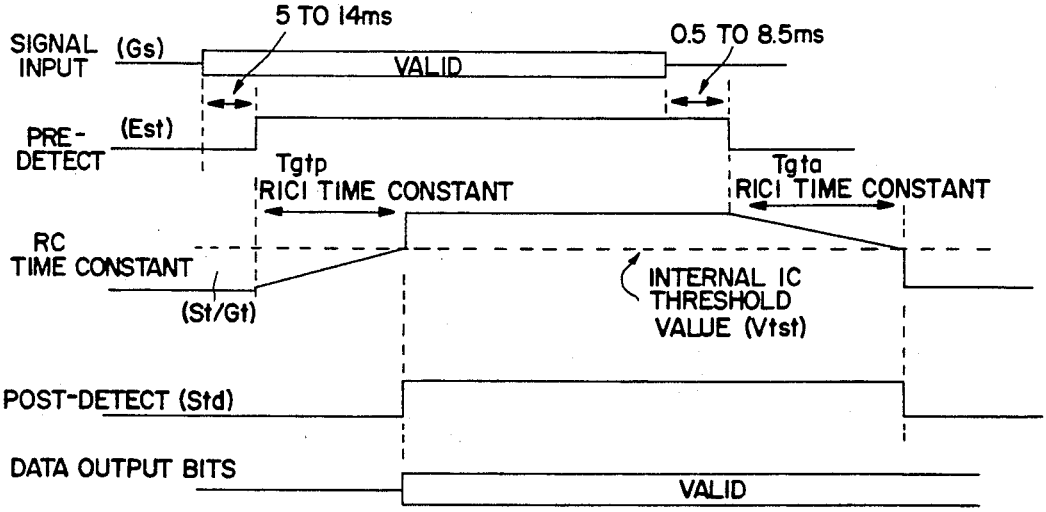
FIG. 3 is a timing diagram which characterizes the operation of the circuit of FIG. 2.

The timing of the operation of the 8870 integrated circuit is depicted in FIG. 3. The pre-detect signal is shown going high 5–14 milliseconds after the analog signal is applied at the input. The 8870 integrated circuit operates such that the pre-detect pin goes low 0.5–8.5 milliseconds after cessation of the analog input. There is an internal threshold value which controls whether the post-detect line is high. The internal threshold value is depicted in the third waveform, and the signal at the St/Gt pin which is compared with the internal threshold is shown as having two time constants labelled Tgtp and Tgta, both determined by the values of R1 and C1. The rise time Tgtp, representing detection of tone presence, and the fall time Tgta, representing detection of tone absence, are equal. It should be noted that, as shown in FIG. 3, the output bits are latched on the rising edge of the post-detect signal and they remain latched even after the post-detect signal goes false.

Figure 1:
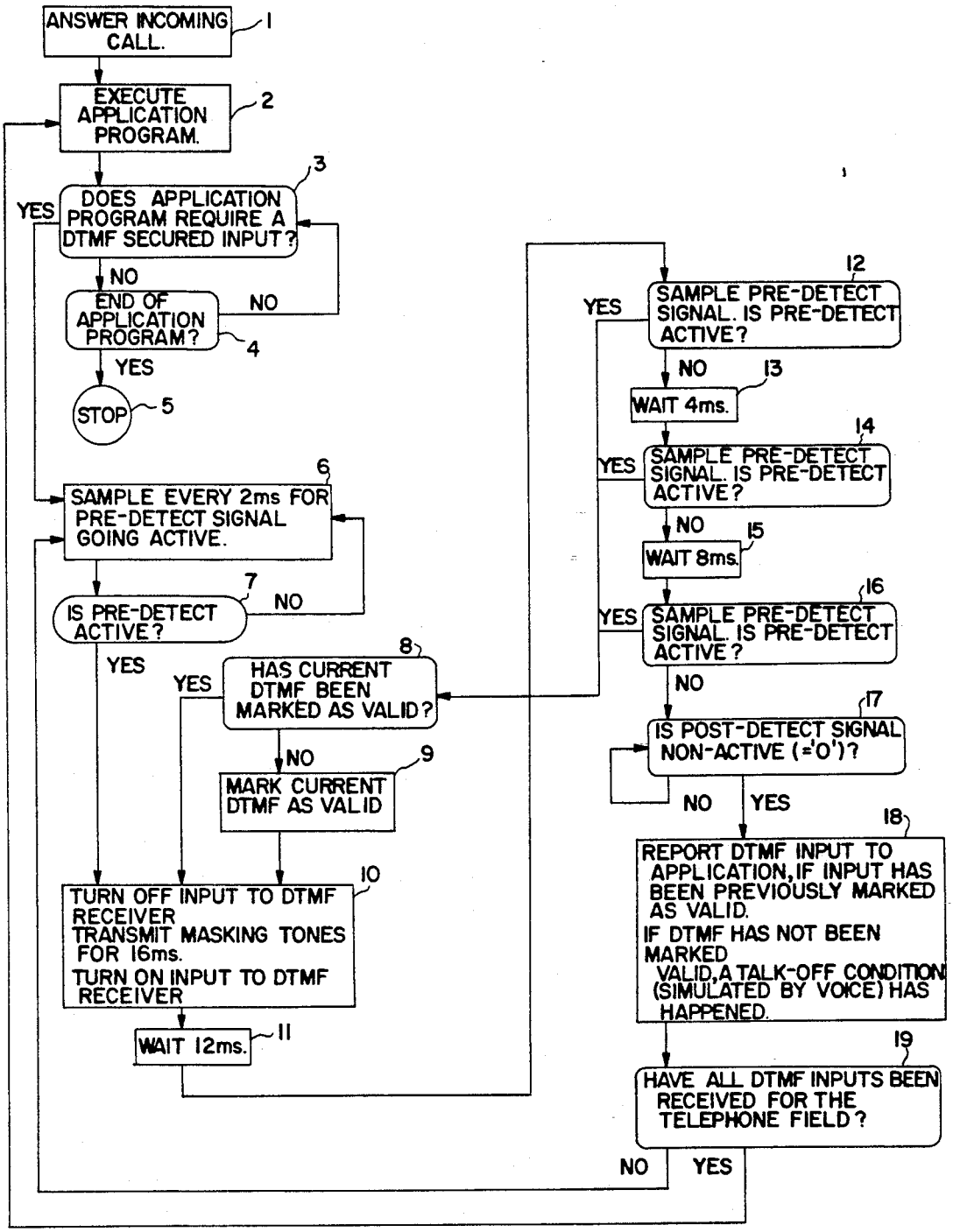
FIG. 1 is a flow chart which depicts the method of our invention.
Figure 6:
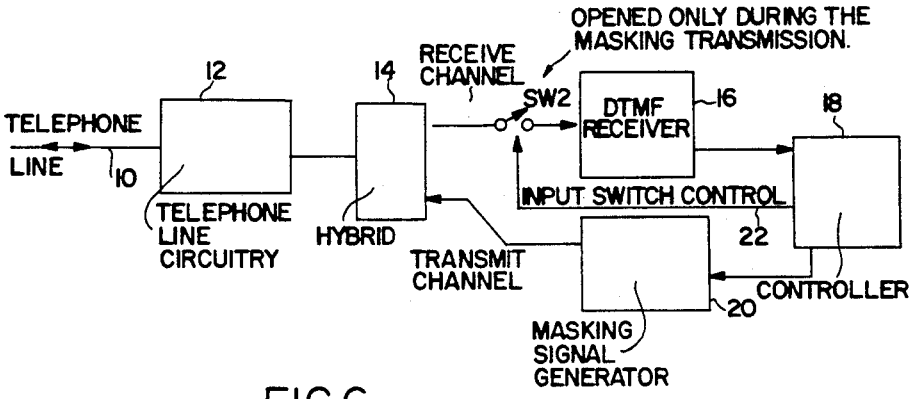
FIG. 6 is a block diagram which depicts the hardware aspect of our invention, the operation of the controller block being as represented in the flow chart of FIG. 1.

The software shown in FIG. 1 is executed by the controller in FIG. 6, the controller typically including a microprocessor. The state of the pre-detect line is reflected by the value stored in a memory mapped location, and the software polls that location every 2 milliseconds. (The shorter the polling time, the faster the masking signal can be applied to the line after a DTMF signal is sensed; a 2-millisecond polling time provides a fast enough response.) The "worst case" timing in the illustrative embodiment of the invention is that in which a masking signal is not applied to the line until 16 milliseconds following the appearance of a DTMF signal on the line. That is because it may take up to 14 milliseconds before the pre-detect line goes high and an additional two milliseconds until that condition is detected by the polling software. On the assumption that once the masking signal is applied to the line it is not feasible for an eavesdropping detector to determine the digits to be masked, this "worst case" timing is adequate because commercially available DTMF receivers cannot validate a DTMF signal in as little as 16 milliseconds.

Figure 4:
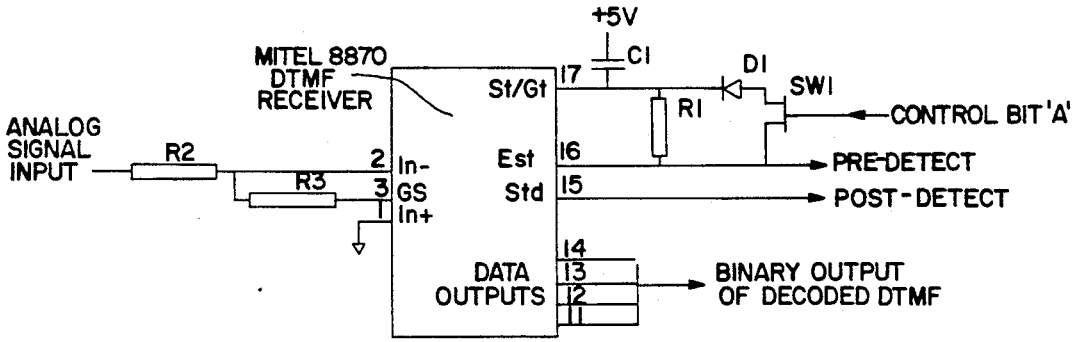
FIG. 4 depicts the manner in which the circuit of FIG. 2 is modified in order to implement our invention.

The conventional circuit of FIG. 2 is modified in the illustrative embodiment of the invention as depicted in FIG. 4. A diode D1 and an FET switch SW1 are added, the switch being controlled by a bit "A" output of the microprocessor in the controller. The switch is in a high impedance state for a logic zero control bit, and a low impedance state for a logic one. With the control bit in the logic zero state, the circuit of FIG. 4 behaves exactly like the circuit of FIG. 2, and the timing of FIG.

3 applies. The modified timing is required only when masking tones are to be applied to the line. Some of the data transmitted by a user will not have to be protected. Consequently, there is no need to apply a masking signal to the line when these DTMF signals are transmitted, and control bit A remains at the logic zero level throughout most of a typical data processing application. It is only when sensitive data is to be masked that switch SW1 is turned on and the modified timing of FIG. 5 ensues.

Figure 5:
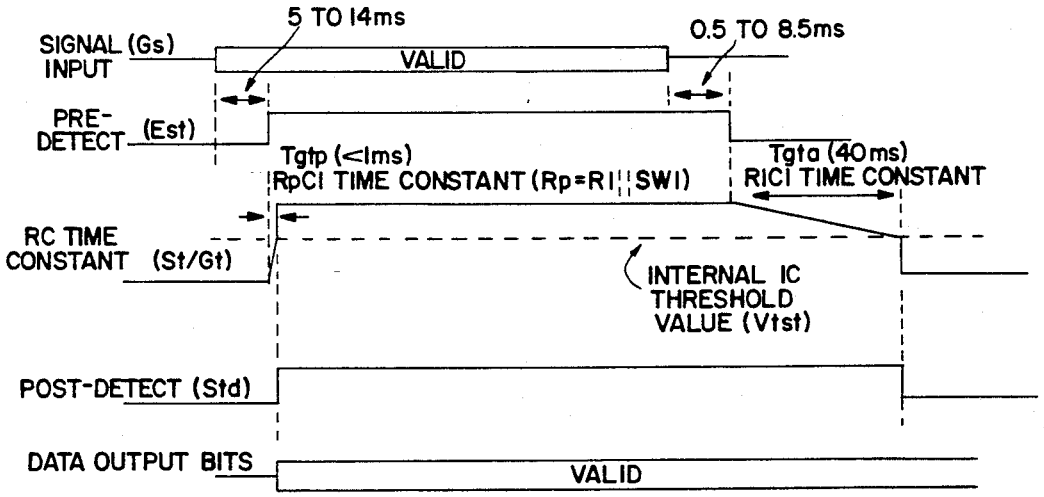
FIG. 5 is a timing diagram applicable to the circuit of FIG. 4.

As shown in FIG. 5, the rising edge of the pre-detect waveform (which occurs no later than 14 milliseconds following initial application of a DTMF signal to the line) causes the post-detect signal to go high almost immediately with the pre-detect signal. It is the shorting of resistor R1 through diode D1 and switch SW1 that decreases the time constant on the rising edge of the post-detect signal. Because of the blocking characteristics of the diode, the falling edge of the post-detect signal relative to the falling edge of the pre-detect signal is the same as depicted in FIG. 3; the time constant at the trailing edge of the St/Gt waveform remains the same.

Resistor R1 is 200K ohms and capacitor C1 is 0.22 uF. Switch SW1, when on, has an impedance of about 100 ohms. As shown in FIG. 5, the Tgtp time constant is much less than 1 millisecond. The measured value of Tgtp in the circuit of FIG. 2 is 28 milliseconds. The measured value of Tgta in both of the circuits of FIGS. 2 and 4 is 40 milliseconds.

During normal operation, it is the pre-detect signal going high which indicates that a DTMF signal may be in progress, although because at most only 14 milliseconds have elapsed it is possible that all that is present is a voice signal some of whose frequencies constitute those of a DTMF signal. Ordinarily it is the post-detect signal going high which is an indication that a valid DTMF signal has been detected. But, as will be described, the masking signal is applied as soon as the pre-detect signal goes high and the masking signal disrupts operation of the DTMF receiver in FIG. 6. Under ordinary circumstances the post-detect signal (as shown in FIG. 2) would not go high to latch the new DTMF representation, since the masking tones are applied immediately, at most 16 milliseconds after tone receipt, which would disable the post-detect signal from going active because of a Tgtp of 28 milliseconds. The reason for causing the post-detect signal to go high immediately with the pre-detect signal (as shown in FIG. 4) is to allow new outputs on pins 11-14 to be represented.

Because the post-detect signal is forced high almost immediately when the pre-detect signal goes high, the talk-off performance of the circuit of FIG. 4 is substantially degraded over that of the circuit of FIG. 2. For every 3-5 false detections using the circuit of FIG. 2, there are more than 1,000 false detections when using the circuit of FIG. 4. That is the reason for control bit "A" in the circuit of FIG. 4—when unsecured inputs are being received, switch SW1 is held off so that the best possible talk-off performance is achieved.

It is clear that there needs to be some way to compensate for the adverse talk-off performance since the post-detect signal goes high together with the pre-detect signal, before enough time has elapsed to verify that a valid DTMF signal is really being transmitted on the line. The solution to the talk-off problem is predicated on the observation that while voice frequencies may trigger a pre-detect signal (and therefore the post-detect signal for the circuit of FIG. 4), this hardly happens at regular intervals. The system of our invention therefore checks that two successive valid pre-detect signals are generated during a DTMF signal detection period. If they are, it is assumed that a valid DTMF signal is in progress.

As soon as the pre-detect signal goes high, the masking signal is applied to the line. At the same time, the line is disconnected from the DTMF receiver (via the switch SW2 in FIG. 6). The pre-detect signal therefore goes low due to absence of the input signal, as shown in FIGS. 2 and 4; the pre-detect signal goes low somewhere between 0.5 and 8.5 milliseconds following cessation of the analog input to the DTMF receiver. The masking signal ceases after 16 milliseconds, at which time the line is connected once again to the DTMF receiver. A check is then made at three separate times to see whether the pre-detect signal has gone high again—at 28 milliseconds after the pre-detect signal first went high, at 32 milliseconds after it first went high, and at 40 milliseconds after it first went high. If the pre-detect signal is high at at least one of these three times, then it is assumed that a valid DTMF signal is in progress. If all three checks are negative, then it is assumed that the initial pre-detect signal was due to a talk-off condition. In one experiment, this process reduced the number of false detections to around 50 (compared with the 1,000 false detections referred to above) which, while representing poorer performance than can be achieved with the circuit of FIG. 2, is nevertheless acceptable.

The sequencing is shown in the flow chart of FIG. 1. Depending upon the particular application, an incoming call is answered in step (1) and the pertinent application program is executed in step (2). It is assumed that during the course of the application program the calling party (user) transmits DTMF signals. In step (3) a test is performed to determine whether the application program requires the next expected DTMF signals to be secure. If they need not be, a test is made in step (4) to see whether the program is at an end, and if not the process repeats itself. If the test in step (4) indicates that the application program has come to an end, processing stops in step (5).

If the test in step (3) reveals that the next DTMF signal is to be secure, a branch is taken to step (6). As described above, every 2 milliseconds the pre-detect signal is examined. As long as the test in step (7) indicates that it is not active, the system returns to step (6) and waits for the pre-detect signal to go high. As soon as a high signal is sensed—at most 16 milliseconds after the DTMF signal first appears on the line—a branch is taken to step (10).

Masking tones are applied to the line for 16 milliseconds. Before they are applied, however, switch SW2 in FIG. 6 is opened so that the analog input is disconnected from the DTMF receiver. This is to block the masking tone energy from the analog input to the receiver; it has been found that the receiver recovers more quickly and more consistently after transmission of the masking tones if the masking tone energy is not allowed to appear at the receiver input. This is especially true when the DTMF signal level is much lower than that of the masking tone level. After 16 milliseconds of masking tones, the masking signal generator is turned off and the input line is connected once again to the DTMF receiver.

It will be recalled that the DTMF receiver used in the illustrative embodiment of the invention has its pre-detect line going high somewhere between 5 and 14 milliseconds following the appearance of a DTMF signal on the line. Experiments revealed that the pre-detect signal goes active within 12 milliseconds 90% of the time. It is for this reason that the first of the three checks takes place 12 milliseconds after the masking signal generator is turned off. In step (11) the system waits for 12 milliseconds. Then, in step (12), the pre-detect signal is sampled once again and the check is made to see whether it is active. If it is, a branch is taken to step (8), which is simply a test to see whether an applicable flag has been marked to indicate that the DTMF signal in progress is valid. If it has, a branch is taken to step (10). If it has not already been marked, it is marked in step (9) and then the branch is taken to step (10).

On the other hand, if in step (12) it is determined that the pre-detect signal is low, in step (13) there is a 4-millisecond wait. In step (14) the same test is performed as was involved in step (12). Once again, if the pre-detect signal is detected, the system makes sure that the flag bit indicating a valid DTMF signal is marked true, and the process then repeats itself. On the other hand, if the pre-detect signal is still low, in step (15) there is another wait of 8 milliseconds, following which the test of steps (12) and (14) is repeated in step (16).

Because the first wait of 12 milliseconds occurs in step (11) after the masking tones are applied to the line for 16 milliseconds, it is apparent that checks for the persistence of the DTMF signal occur 28 milliseconds, 32 milliseconds, and 40 milliseconds after the pre-detect signal first went high. The system does not check continuously for the pre-detect signal being active for the simple reason that due to the nature of talk-off, voice inputs will cause many active pre-detects, and therefore checking continuously for an active pre-detect signal will result in too many false DTMF detections. It is far preferable to check at three specific times. The technique relies on the fact that voice simulated pre-detects are randomly generated and only a small percentage will create second valid pre-detects at distinct timings of 28, 32 or 40 milliseconds.

The only way that the system can reach step (17) in FIG. 1 is if 24 milliseconds have transpired after the masking signal was turned off without the pre-detect line having gone high again. This may happen when the DTMF signal keyed in by the calling party ceases, or it may simply result 40 milliseconds after a pre-detect simulated by voice. In either case, in step (17) the system waits until the post-detect signal deactivates. As discussed above, and as shown in FIG. 5, this happens a little more than 40 milliseconds after the pre-detect signal deactivates due to the loss of the DTMF input at the receiver end. On the falling edge of the post-detect signal, an interrupt is generated and the software, in step (18), checks whether the previously processed flag has been marked to indicate a valid input. If the flag has been set, a report is made to the application software that a valid DTMF signal has been received. If the flag has not been marked, the DTMF input is not used since a talk-off condition (simulated by voice) has occurred.

The system moves on to step (19) at which time a test is performed to see whether all DTMF digits have been received. If they have, a return is made to step (2) where execution of the application program continues. If more DTMF digits are expected, a branch is taken to step (6) at which time sampling of the pre-detect signal takes place.

It should be noted that no adjustment is made in the masking tone level as a function of line characteristics, the technique disclosed in the prior art referred to above. This avoids the need to use sophisticated hardware for echo cancellation purposes. The masking tones preferred are 941 Hz, 1,209 Hz and 1,633 Hz, one row and two column frequencies. This combination has proven to provide the best blocking capabilities for all 16 Touchtone digits in laboratory testing. Each frequency is transmitted at a −3 dbm level.

The hardware of the present invention is even simpler than those earlier disclosed. Referring to FIG. 6, telephone line 10 is connected to conventional telephone line circuitry 12 which is coupled to a conventional hybrid circuit 14. The receive channel is coupled through switch SW2 to DTMF receiver 16. Controller 18, which includes the microprocessor which executes the software of FIG. 1, applies a signal to input switch control conductor 22 for operating switch SW2; the switch is opened only during the transmission of a masking signal. The controller also turns on masking signal generator 20 when the masking signal is required, the output of the generator being applied to the transmit channel of the hybrid circuit.

Figure 7:
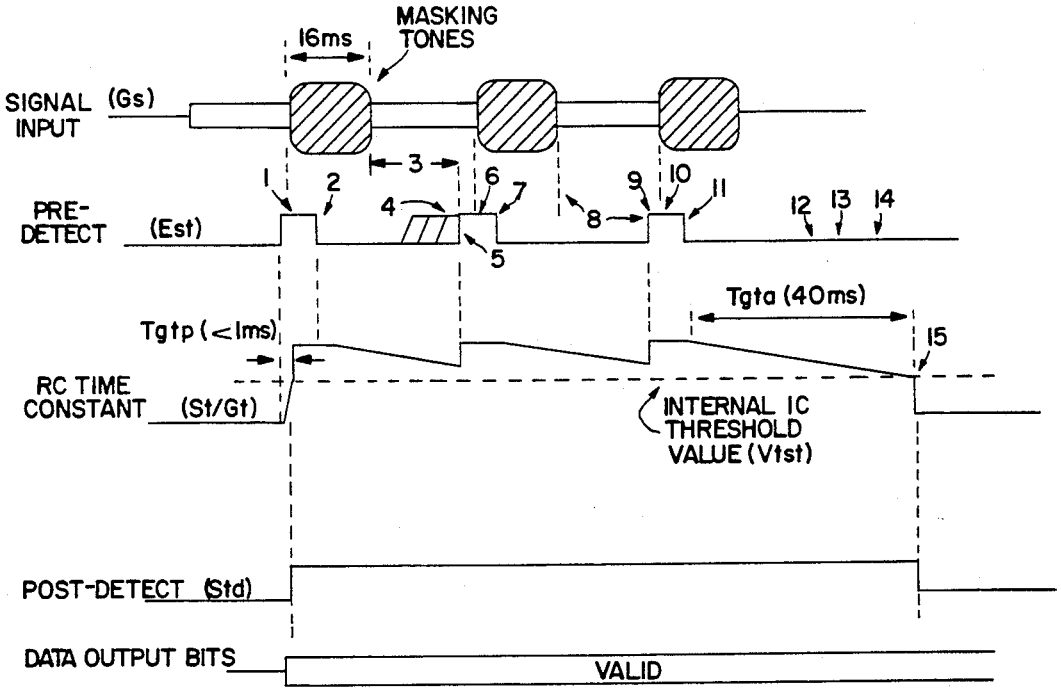
FIG. 7 is a timing diagram which shows a typical masking signal sequence in accordance with the principles of our invention.

The overall timing is depicted in FIG. 7. Event (1) is the software recognition of a pre-detect signal. The system starts to generate 16 milliseconds of masking tones and, because the RC time constant is essentially zero, the post-detect signal becomes active almost immediately. Since the analog input is removed from the input of the DTMF receiver, the pre-detect signal becomes inactive 0.5–8.5 milliseconds after event (1). It is when this happens, designated event (2), that the signal at pin 17 in FIG. 4 starts to decay with a time constant of 40 milliseconds. Capacitor C1 (FIG. 4) starts to charge as soon as the pre-detect signal goes low. The charge time constant is 40 milliseconds, as depicted in FIG. 5. Long before the voltage at pin 17 reaches the threshold level which forces the post-detect line to go inactive, the masking signal is turned off and the line is connected once again to the input of the DTMF receiver. When this happens, it requires 5–14 milliseconds for the pre-detect signal to go high once again, and the entire process repeats itself. The 40-millisecond time constant at the trailing edge of the signal at pin 17 ensures that the post-detect signal stays high until the DTMF signal has terminated.

After the application of masking tones to the line for 16 milliseconds, switch SW2 in FIG. 7 is closed and the DTMF receiver starts to work again. Event (3) occurs 5–14 milliseconds after the cessation of the masking tone application, with the pre-detect line becoming active again. In the example of FIG. 7, it is assumed that the pre-detect line goes active a second time 14 milliseconds after the cessation of the masking tones, i.e., event (5) occurs 30 milliseconds after event (1).

Because in step (12) of FIG. 1 the pre-detect signal is sampled 28 milliseconds after event (1) in FIG. 7, this sampling, event (4) in FIG. 7, is shown occurring before event (5). Since the pre-detect line is inactive, referring to the flow chart of FIG. 1 the system branches from step (12) to step (13), rather than to step (8). The system waits an additional 4 milliseconds before testing the pre-detect output again, without transmitting masking tones in the interim because the masking signal generator is turned on only in step (10) after first going through step (8). Event (6), the sensing of the pre-detect signal in step (14) of FIG. 1, occurs 32 milliseconds from event (1) in FIG. 7. It should be noted that the pre-detect line goes high, event (5), at a time between two sampling steps, events (4) and (6). This is of no moment except, of course, that capacitor C1 in FIG. 4 discharges and the potential at pin 17 jumps to its upper limit. It is at event (6), corresponding to step (14) in FIG. 1, that the pre-detect signal is sensed for the second time. A branch is taken to step (8) in FIG. 1, following which the DTMF input is marked valid and masking tones are applied to the line once again. Masking tones are applied again (and again and again) because as long as the user is operating his keypad, an eavesdropping detector must be foiled. Masking tones are interrupted, at least sufficiently to ensure proper detection at the receiver, but not sufficiently to preclude confusion of the eavesdropping equipment.

It should be appreciated that the software samples the pre-detect signal and, depending on its state, determines whether or not to apply masking tones to the line. But the DTMF receiver operates on its own in the sense that the pre-detect line goes high automatically 5–14 milliseconds after the cessation of the masking tones.

Event (7) corresponds to event (2), and event (8) corresponds to event (3). This time it is assumed, however, that event (8) occurs 9 milliseconds after the cessation of the masking tones, i.e., event (9) occurs 25 milliseconds after event (6). The pre-detect signal becomes active, and the decaying RC waveform is reset. Referring to the flow chart of FIG. 1, the test of step (12) occurs 28 milliseconds after the start of the second masking tone application. Event (10) in FIG. 7 is the sampling of the pre-detect line 28 milliseconds after event (6). Because the pre-detect line is active, a branch is taken to step (8) in FIG. 1, corresponding to event (10) in FIG. 7, and the masking tones are applied to the line once again. Event (11) corresponds to event (2), with the pre-detect signal going low.

Event (12) corresponds to step (12) in FIG. 1—testing of the pre-detect line 28 milliseconds after the last masking tone generation. On the assumption that the DTMF signal has terminated, the pre-detect line is low, and the software moves on to step (14) in FIG. 1. Event (13) corresponds to the pre-detect test at 32 milliseconds, and event (14) corresponds to the pre-detect test at 40 milliseconds. Because the DTMF signal has terminated and the pre-detect signal is low, the system moves on to step (17) in FIG. 1. Event (15) forty milliseconds after the pre-detect signal has gone low, by which time capacitor C1 has discharged to below the threshold level, the post-detect line goes low. At this time the test in step (17) allows a continuation with step (18). The application software is informed that a valid DTMF signal has been received. In step (19) a decision is made whether to look for additional DTMF signals, and an appropriate branch is taken.

It is in step (18) that the software can actually determine for the first time which digit was transmitted. With the post-detect line going low, it is known that the four output bits were latched when the post-detect line first went high. The bits did not change during the detection process because they can change only when post-detect first goes high. And if the DTMF signal actually changes during an active reception, the Mitel receiver causes pre-detect to go low as if the initial input has ceased which will cause the post-detect signal to become inactive. If the flag bit is marked valid, it is because an active pre-detect was sampled twice, the second time at a predetermined interval after the first, and that is a good indication that the signal being received is indeed a valid DTMF tone pair.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

We claim:

1. An improved method for inhibiting intelligible interception of an information signal transmitted over a communications path from a first site to a second site, comprising the steps of:

(a) detecting, at said second site, a predetermined characteristic of said information signal;

(b) applying to said communications path, at said second site, a masking signal following said detection of said predetermined characteristic but prior to the time at which the validity of said information signal is verified by said second site;

(c) terminating said masking signal; and (d) thereafter verifying the validity of said information signal.

2. A method in accordance with claim 1 wherein said verifying step comprises interrogating said communications path for the presence of said information signal.

3. A method in accordance with claim 2, further including the step of:

(e) periodically removing said masking signal from said communications path to facilitate detection of the cessation of said information signal.

4. A method in accordance with claim 2 wherein in step (d) said communications path is interrogated at predetermined times and wherein the validity of said information signal is verified if it is detected at at least one of said predetermined times.

5. A method in accordance with claim 4 wherein said predetermined times are selected so as to reduce the incidence of erroneous detection of information signals.

6. A method in accordance with claim 4 wherein said predetermined times are irregularly spaced apart from said detection of said predetermined characteristic.

7. A method in accordance with claim 1 wherein step (a) comprises detecting a predetermined characteristic of a DTMF signal.

8. A method in accordance with claim 7 wherein a standard DTMF detector, having respective post-detect and pre-detect output pins associated therewith, is used to detect said information signal, and step (a) includes the sub-step of energizing said post-detect output pin immediately upon energization of said pre-detect output pin, energization of said post-detect output pin being indicative of the presence of a DTMF signal, and subsequent de-energization of said post-detect output pin being indicative of the cessation of said DTMF signal.

9. A method in accordance with claim 1 wherein a plurality of said information signals are transmitted from said first site to said second site, and further wherein steps (a)–(d) are executed at said second site with respect to selected ones of said plurality of said information signals.

10. A method in accordance with claim 1 wherein said step of detecting a predetermined characteristic comprises detecting a characteristic of a signal other than an information signal.

11. A system for inhibiting intelligible interception of an information signal transmitted over a communications link from a first site to a second site, said second site comprising:

a detector configured to detect a predetermined characteristic of said information signal;

a signal generator configured to apply to said communications link a masking signal following detection of said predetermined characteristic but prior to the time at which validity of said information signal is verified; and control means for terminating said masking signal.

12. A system in accordance with claim 11 further comprising means for determining the validity of said information signal received at said second site by verifying the presence of said information signal at at least one predetermined time after said detection of said predetermined characteristic.

13. A system in accordance with claim 12 wherein said control means is configured to periodically remove said masking signal from said communications link, and said determining means is configured to interrogate said communications link for the presence of said information signal when said masking signal is not being applied to said communications link.

14. A system in accordance with claim 11 wherein said detector includes a standard DTMF detector including respective pre-detect and post-detect output pins, said detector being configured to energize said post-detect output pin immediately upon energization of said pre-detect output pin, wherein energization of said post-detect output pin is indicative of the presence of said information signal at said second site, and de-energization of said post-detect output pin is indicative of the cessation of said information signal.

15. A system in accordance with claim 11 wherein said control means periodically removes said masking signal from said communication slink to facilitate verification of said information signal and a determination of the cessation thereof.

16. A system in accordance with claim 11 wherein said second site is configured to interrogate said communications link at predetermined time intervals following said detection of said predetermined characteristic, and to validate said information signal if it is detected at at least one of said predetermined times.

17. A system in accordance with claim 16 wherein said predetermined times are such that the incidence of voice talk-off resulting in erroneous detection of DTMF signals is reduced.

18. A system in accordance with claim 17 wherein said predetermined times are irregularly spaced apart.

19. An apparatus for inhibiting the unauthorized interception of an information signal transmitted from a transmitting site to a receiving site along a transmission path, comprising:

a detector, disposed at said receiving site, for detecting the presence of a characteristic of said information signal on said transmission path;

a generator, disposed at said receiving site, for applying a masking signal to said transmission path substantially immediately after said detector first detects said predetermined characteristic and for effecting cessation of said masking signal a predetermined time thereafter;

means for interrogating said transmission path and for generating a first signal based on the presence of said information signal on said transmission path following said cessation of said masking signal; and means for ascertaining the validity of said information signal based on said first signal.

20. The apparatus of claim 19 wherein said information signal comprises a DTMF signal.

* * * * *